US005789822A

United States Patent [19]

Calistrat et al.

[11] Patent Number: 5,789,822

[45] Date of Patent: Aug. 4, 1998

[54] SPEED CONTROL SYSTEM FOR A PRIME MOVER

[75] Inventors: Michael M. Calistrat, Missouri City; Lynn A. Revak, La Porte, both of Tex.

[73] Assignee: Revak Turbomachinery Services, Inc., La Porte, Tex.

[21] Appl. No.: 695,404

[22] Filed: Aug. 12, 1996

[51] Int. Cl.[6] ..... F02N 11/06; H02P 9/04

[52] U.S. Cl. ..... 290/40 A; 290/40 C; 290/51; 415/36; 415/311; 415/175; 60/431; 60/435

[58] Field of Search ..... 290/40 A, 40 C, 290/51; 415/36, 175, 310, 311; 272/33 R, 28 R; 60/431, 435

[56] References Cited

U.S. PATENT DOCUMENTS

| | | | |
|---|---|---|---|
| 2,748,294 | 5/1956 | Kimberling | 290/40 |
| 3,884,038 | 5/1975 | Forster et al. | 60/413 |
| 4,204,258 | 5/1980 | Zitelli et al. | 290/40 |
| 4,791,309 | 12/1988 | Payne et al. | 290/40 |
| 4,811,942 | 3/1989 | Rusk | 272/33 R |
| 4,835,969 | 6/1989 | Tallman | 60/39.281 |
| 4,837,697 | 6/1989 | Eisa et al. | 364/431 |
| 4,853,552 | 8/1989 | Kure-Jensen et al. | 290/40 |
| 5,040,648 | 8/1991 | Mitchell et al. | 192/3.58 |
| 5,111,788 | 5/1992 | Washino | 290/40 |
| 5,261,797 | 11/1993 | Christenson | 417/380 |
| 5,321,308 | 6/1994 | Johncock | 290/40 |
| 5,421,702 | 6/1995 | Revak et al. | 415/175 |

OTHER PUBLICATIONS

"Dynalco STC 202 Speed Controller/Governor" Dynalco Corporation, 1982, 19 pages.

"Digital Programmable Control System" Woodward Governor Company, 1986, 8 pages.

"TS110 Self-Powered Governor" TRI-SEN Systems, Inc., date unknown, 4 pages.

"Magnetic Pickup Powered Electronic Governor" Dynalco Controls, 1989, 4 pages.

"509 Digital Control System" Woodard Governor Company, 1989, 6 pages.

"TG-13 and 17 Governor Manual 04042" Woodard Governor Company, 1984, 33 pages.

*Primary Examiner*—Steven L. Stephan

*Assistant Examiner*—Elvin G. Enad

*Attorney, Agent, or Firm*—Bush, Riddle & Jackson

[57] ABSTRACT

An electronic governor (34) to control a main steam valve (22) of a steam turbine (10) for controlling the rotational speed of a main drive shaft (16). The electronic governor (34) has a housing (36) in which an electric generator (104) is mounted to supply electrical energy to an electronic module (100) mounted on the housing (36). A hydraulic fluid pump (52) is mounted on the housing (36) and supplies fluid to a fluid operated piston (62) to effect a predetermined rotation of an output control shaft (32) and movement of main steam valve (22). Output signals from a microprocessor (116) to solenoid operated valves (96, 98) control the movement of fluid operated piston (62). Pump shaft (46) and generator shaft (48) are in axial alignment with and driven by the main drive shaft (16) to provide all of the power for operation of the electronic governor (34).

16 Claims, 5 Drawing Sheets

SPEED CONTROL SYSTEM FOR A PRIME MOVER

FIELD OF THE INVENTION

This invention relates to a speed control system for a prime mover having a main drive shaft, such as a turbine or internal combustion engine, and more particularly to such a speed control system utilizing electronic control means for controlling the rotational speed of the main drive shaft of the prime mover.

BACKGROUND OF THE INVENTION

Heretofore, various governors driven from the main drive shaft of a prime mover, such as a turbine, have been utilized for controlling the rotational speed of the main drive shaft. A main control valve in the steam line to the turbine is adjusted to vary the amount of steam delivered to the turbine. When the turbine is under a heavy load and the rotational speed of the main drive shaft is decreased, the control valve is actuated to provide an increased amount of steam to the turbine to increase the rotational speed of the main drive shaft. When the turbine is under a light load and the rotational speed of the main drive shaft increases, the control valve is actuated to provide a reduced amount of steam to the turbine to decrease the rotational speed of the main drive shaft.

Governors have been provided heretofore which have utilized mechanical control means as well as electronic control means. Mechanical control means have normally comprised a piston operatively connected to a control shaft for the main control valve to effect movement of the control shaft and associated main control valve, and a hydraulic fluid pump to supply pressurized fluid selectively to the piston in response to the rotational speed of the main drive shaft.

Electronic control means for governors have been provided heretofore which are responsive to the rotational speed of a drive shaft and sense various parameters of the turbine, such as, for example, temperature, vibration, rotational speed of the main drive shaft, and position of the main control valve. However, all of the electronic control means heretofore associated with a governor to control the rotational speed of a main drive shaft of a prime mover have required an external power source such as electrical energy or pressurized air, for example. It is desirable that no external source of power or energy be required for operation of the main control valve, governor and associated electronic control means.

SUMMARY OF THE INVENTION

The present invention is directed particularly to a speed control system for a prime mover having a main drive shaft and utilizing a governor having an electronic control means for controlling the rotational speed of the main drive shaft. The electronic governor has an enclosed outer housing receiving a generator providing electrical energy for the electronic control means and driven from the main drive shaft for generating electrical energy.

A main control valve is positioned in the fluid line to the prime mover, such as a steam line to a turbine, to control the amount of fluid supplied to the prime mover for effecting rotation of the main drive shaft. An adjustable output control shaft extends from the governor housing and is operatively connected to the main control valve to effect movement of the main control valve when rotated. Thus, the position of the main control valve is determined by the position of the output shaft from the governor.

A fluid operated piston is mounted within the governor housing and is operatively connected to the output shaft to effect movement of the output shaft. A hydraulic fluid pump driven from the main drive shaft supplies hydraulic fluid selectively to opposed ends of the fluid operated piston for a controlled movement of the piston and associated output shaft. The amount of fluid selectively supplied to opposite ends of the piston is controlled by solenoid operated valves in the fluid lines to the piston. The electronic control means of the governor transmits output signals to the solenoid operated valves for selective opening and closing of the solenoid operated valves to vary selectively the amount of fluid supplied to the piston in response to the rotational speed of the main drive shaft. The electronic control means also senses various parameters of the prime mover, such as temperature, vibration, rotational speed of main drive shaft, and position of the main control valve, for example.

The electronic control means includes an electronic module which in its preferred embodiment is removably secured to an end of the governor housing and forms an end for the housing. The governor housing is filled with hydraulic oil which forms a reservoir for the hydraulic fluid pump. The pump shaft and generator shaft are coupled to the main drive shaft of the turbine to provide the sole power sources for the governor. The electronic governor is formed as a single integral unit which may be easily coupled to a main drive shaft of a prime mover. While the pump shaft and generator shaft are shown as driven directly from the main shaft, it is understood that the pump shaft and generator shaft may be driven indirectly from the main drive shaft such as being driven from an auxiliary shaft which rotates at a speed proportional to the rotation of the main shaft.

It is an object of this invention to provide a speed control system for a prime mover having a main drive shaft and utilizing a governor having an electronic control means for controlling the rotational speed of the main drive shaft.

Another object of this invention is to provide an electronic governor for such a speed control system powered solely from the main drive shaft and not requiring any external source of power or energy.

A still further object is to provide such a governor having an electric generator mounted within an outer governor housing and driven from the main drive shaft to supply energy to the electronic control means.

Other objects, features, and advantages of the invention will become more apparent from the following specification and drawings.

DESCRIPTION OF THE INVENTION

Figure 1:
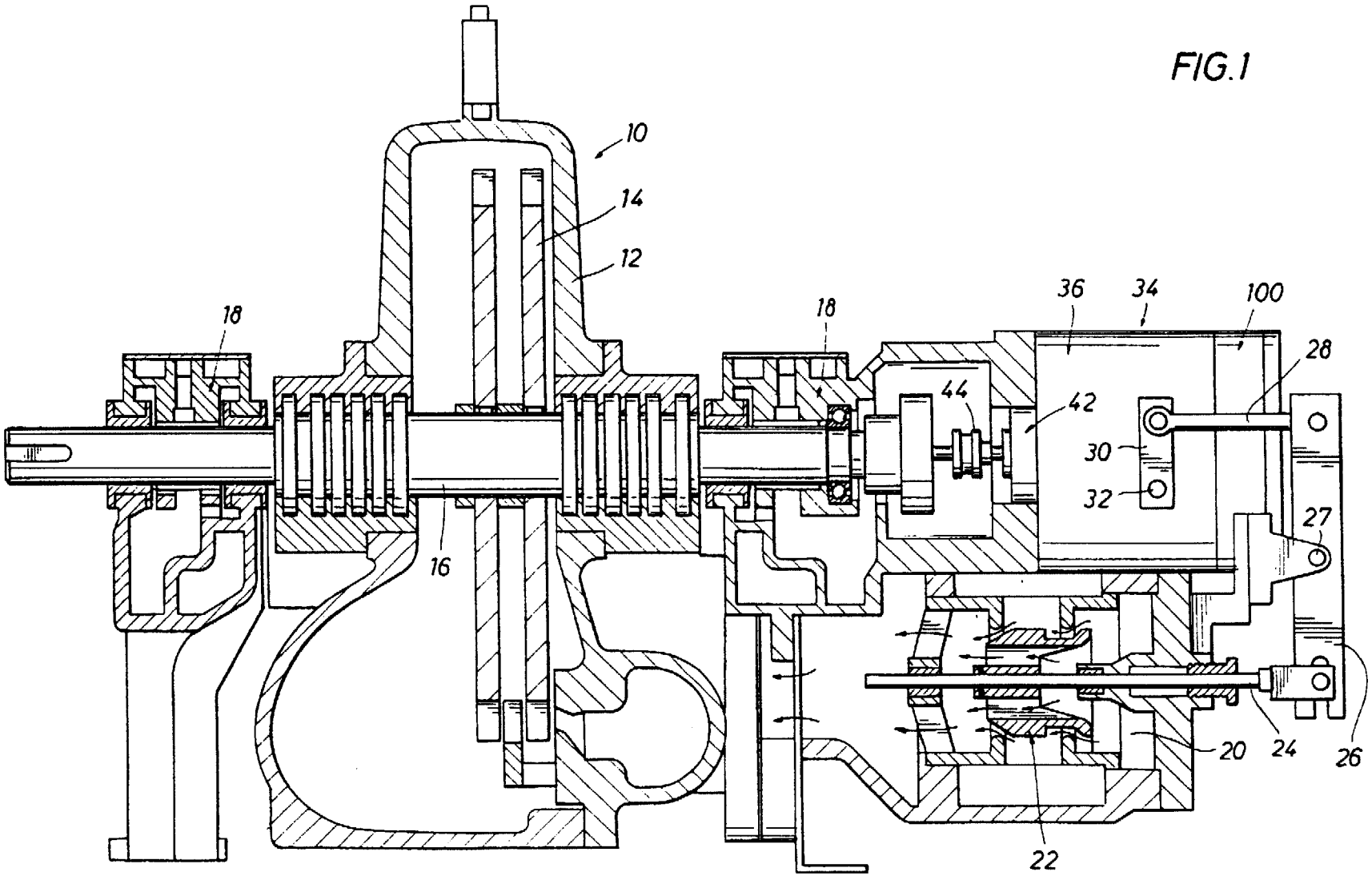
FIG. 1 is a sectional view, partly schematic, of a steam turbine with the electronic governor comprising the present invention mounted thereon to control the flow of steam to the turbine.

The electronic governor of the present invention is used in a speed control system to control the rotational speed of a main drive shaft of a prime mover, such as an internal combustion engine or a turbine, by controlling the amount of fuel or steam provided to the prime mover. For the purposes of illustration, the prime mover is illustrated in the drawings as a steam turbine, but it is understood that the electronic governor comprising this invention may be utilized with other prime movers to control the rotational speed of a main drive shaft.

Referring now to the drawings and more particularly to FIG. 1, a steam turbine shown generally at 10 has an outer casing 12 enclosing a rotor assembly 14 on a main drive shaft 16. Bearings indicated generally at 18 support drive shaft 16 for rotation. Steam is supplied to the turbine 10 through steam line 20 and a main steam control valve generally indicated at 22 is mounted in steam line 20 to control the flow of steam to turbine 10. Rod 24 is secured to steam valve 22 and is pivotally mounted on one end to lever 26 fixed about pivot 27. The other end of lever 26 has a link 28 pivotally connected to an arm 30 fixed to an output shaft 32 of an electronic governor indicated generally at 34. Rotation of output shaft 32 effects movement of steam control valve 22. Electronic governor 34 is effective to provide a controlled rotation of output shaft 32 for positioning main control valve 22 at a desired position to provide a constant rotational speed of main drive shaft 16 as will be explained further.

Figure 2:
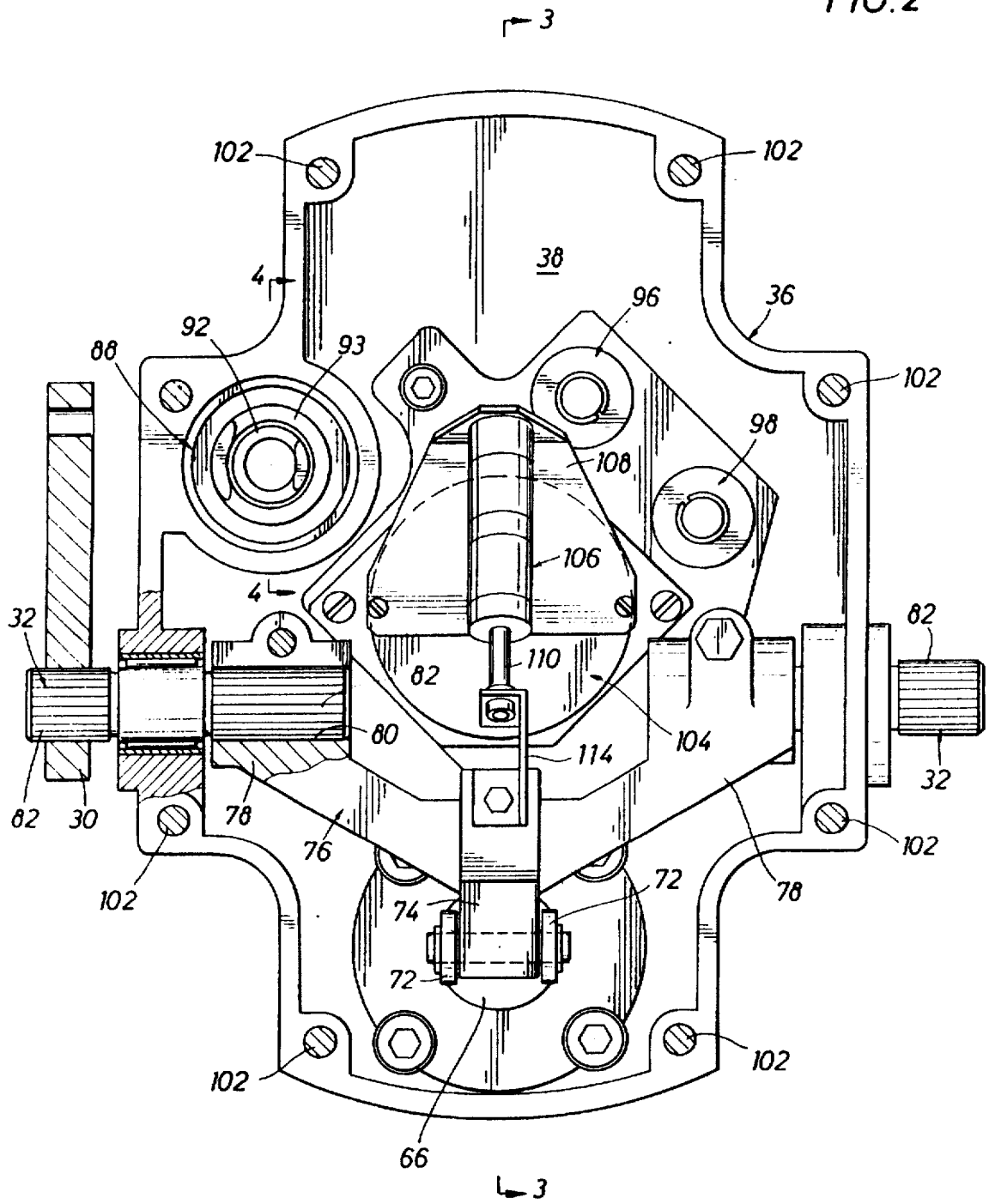
FIG. 2 is a view of the outer housing for the electronic governor with the outer electronic control module removed from the outer housing to show the components within the outer housing.
Figure 3:
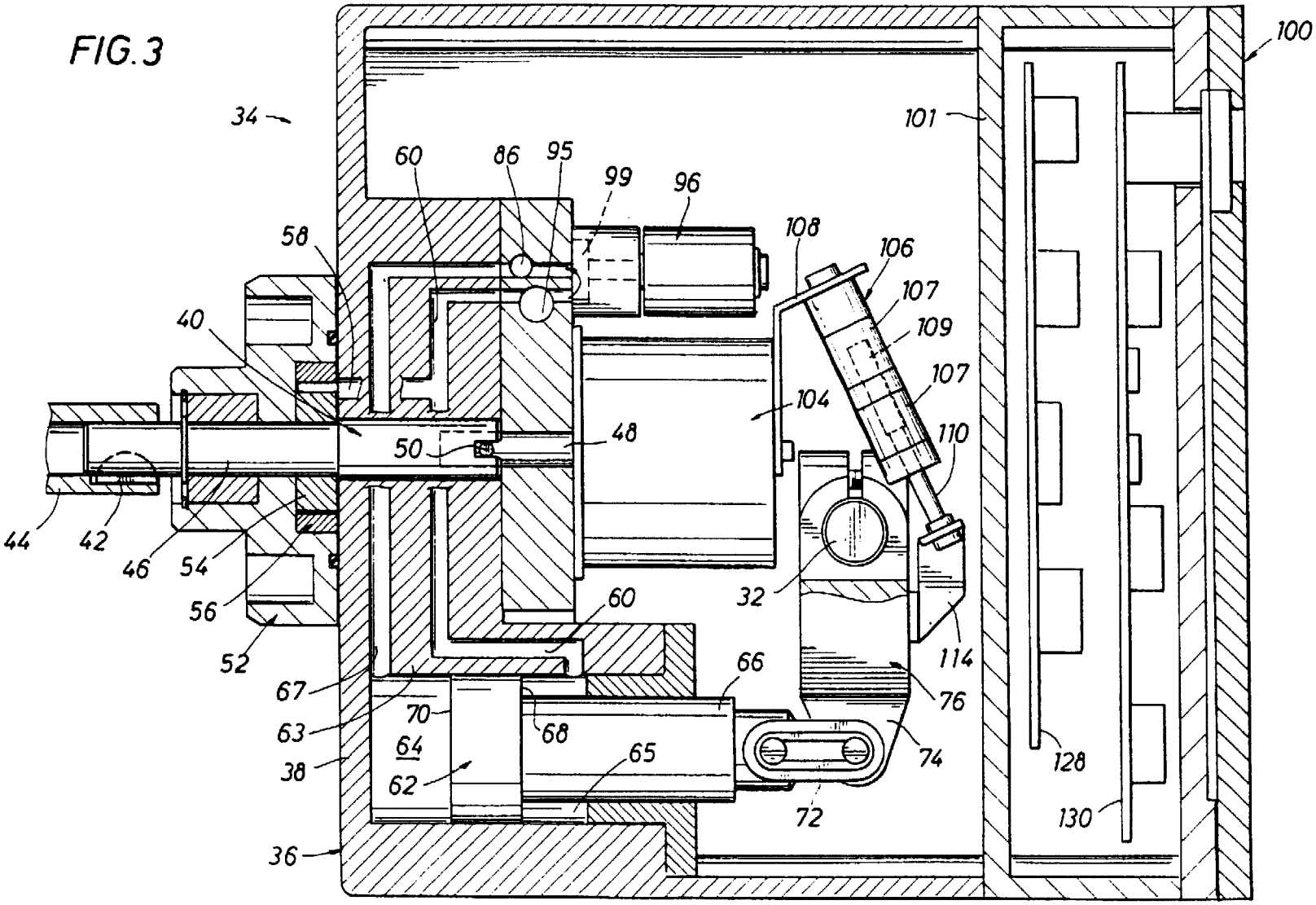
FIG. 3 is a section taken generally along line 3—3 of FIG. 2 and showing particularly the hydraulic fluid pump and electric generator with the outer electronic control module mounted on the outer housing.

Electronic governor 34 has an outer housing generally indicated at 36 having an end 38 as shown particularly in FIGS. 2 and 3. A governor shaft indicated generally at 40 is keyed at 42 to a coupling 44 connected to main drive shaft 16. Governor shaft 40 includes a pump shaft 46. A generator shaft 48 is keyed at 50 to governor shaft 40. Thus, main drive shaft 16 drives governor shaft 40 including pump shaft 46 and generator shaft 48 which are in axial alignment with main drive shaft 16.

A rotary internal gear pump generally indicated at 52 has an inner gear 54 and an outer gear 56 to supply hydraulic fluid or oil through passage 58 and passage 60 continuously to a fluid operated control piston 62 mounted within cylinder 63. A fluid pump similar to pump 52 is sold by Woodward Governor Company, Fort Collins, Colo. with Models TG-13 and TG-17 mechanical governors.

Piston 62 is mounted within a piston chamber 64 of cylinder 63 and has a stem 66 connected thereto. A fluid passage 67 extends to chamber 64 and a fluid passage 60 extends to chamber 65. Annular rear face 68 of piston 62 has an effective fluid pressure area substantially less than the fluid pressure area of front face 70. Stem 66 is connected by a pair of links 72 to a projection 74 on a yoke 76 having a pair of opposed arms 78. Each arm 78 has an internally splined opening 80 meshing with an externally splined shaft portion 82. Arm 30 has an internally splined opening receiving an associated externally splined shaft portion 82 as shown particularly in FIG. 2. Output shaft 32 thus is formed by two axially aligned shaft portions fixed to arms 78 of yoke 76. Movement of piston 62 effects rotation of splined shaft portions 82 and arm 30 which results in pivoting lever 26 to move main control valve 22.

Figure 5:
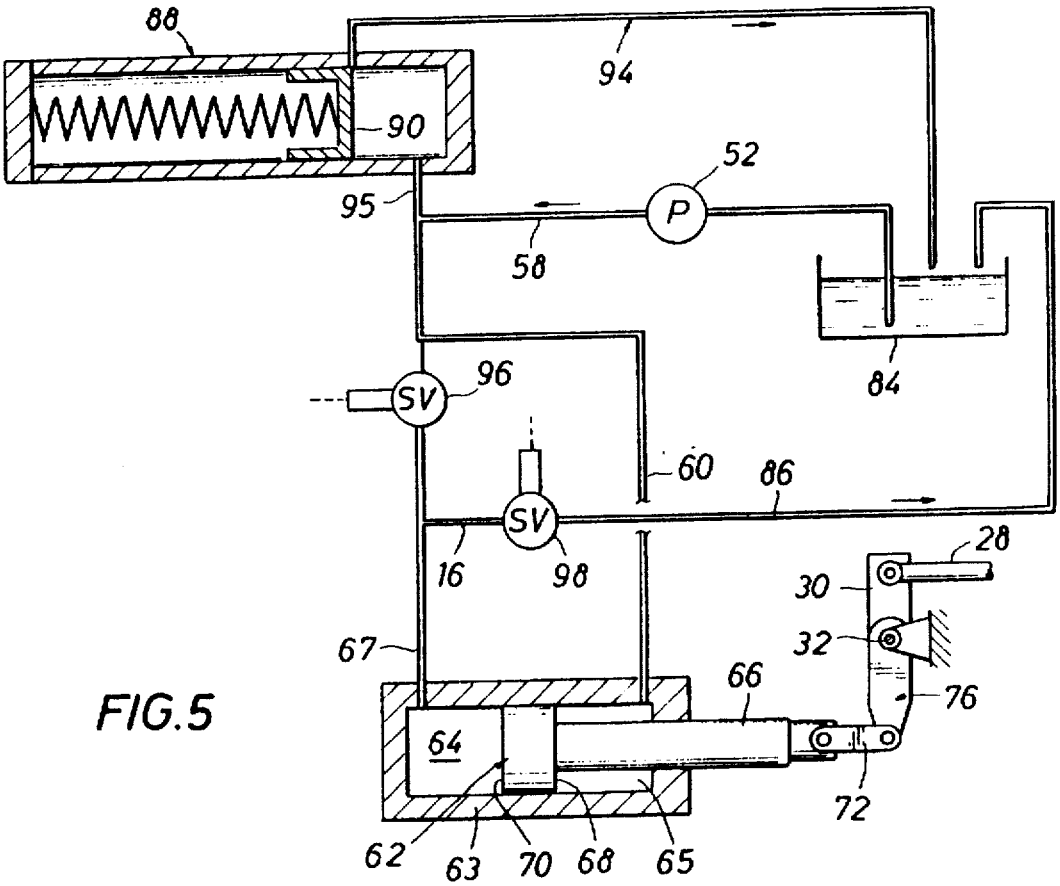
FIG. 5 is a schematic of the hydraulic fluid system for the electronic governor shown in FIG. 1 and showing a control piston responsive to a pair of solenoid operated valves for effecting movement of the control piston and main steam control valve.
Figure 4:
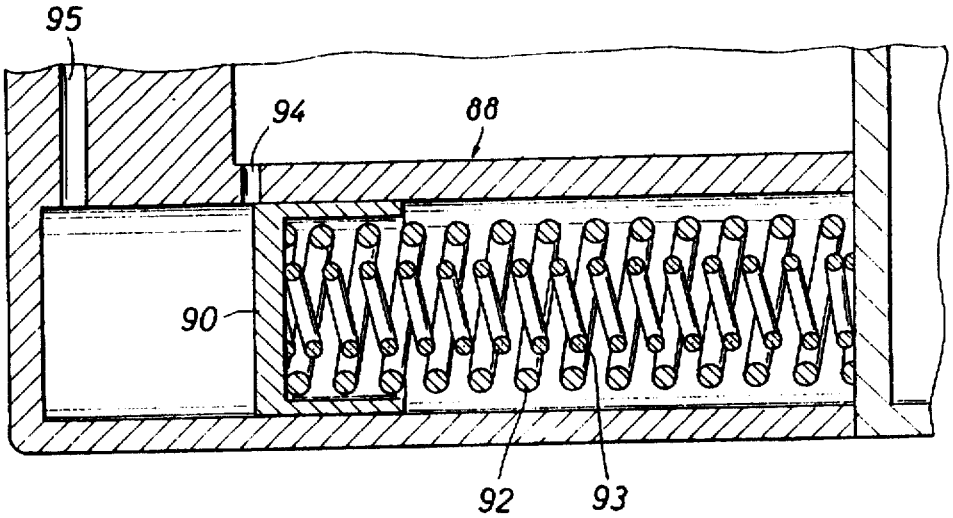
FIG. 4 is a section taken generally along line 4—4 of FIG. 2 and showing the hydraulic fluid accumulator.

Referring now particularly to FIG. 5, the hydraulic fluid system for governor 34 is shown schematically. Pump 52 supplies pressurized fluid from sump or reservoir 84 through passages 58 and 60 to one end of piston 62 adjacent annular face 68. A return fluid line or fluid passage 86 returns fluid to reservoir 84 from chamber 64. Fluid is continuously supplied to chamber 65 through line 60. To maintain the fluid pressure at a predetermined level, an accumulator or pressure regulator is shown at 88 particularly in FIG. 4. An accumulator piston 90 is urged toward one end of accumulator 88 by compression springs 92 and 93. A port 95 from line 58 continuously supplies fluid from pump (P) 52 to accumulator 88. A return line 94 returns fluid to reservoir 84 from accumulator 88 when the predetermined pressure level is reached as indicated by the position of piston 90 in FIGS. 4 and 5. When the fluid pressure in line 58 and port 95 decreases to an amount below the set pressure, piston 90 blocks fluid return line 94 until the fluid pressure is increased to the set pressure level. Springs 92, 93 may be adjusted for a predetermined pressure level if desired.

A solenoid operated fluid valve (SV) 96 is positioned in pressure line 67 to chamber 64 and a solenoid operated fluid valve (SV) 98 is positioned in return line 86. Each valve 96, 98 has a plunger 99 as shown in FIG. 3 normally blocking fluid flow through the lines 67 and 86. In this position, piston 62 remains in a fixed position along with main control valve 22. When solenoid valve 96 is energized, plunger 99 is retracted to provide fluid communication between lines 58 and 67 for the supply of pressurized fluid to chamber 64. Since the fluid pressure area of front face 70 of piston 62 in chamber 64 is greater than the fluid pressure area of rear face 68 of piston 62 in chamber 65, piston 62 moves to the right as viewed in FIGS. 3 and 5 to rotate output control shaft 32 in a clockwise direction and effect movement of link 28 and lever 26 to a position to increase the opening of main steam control valve 22 for increasing the steam flow to turbine 10 thereby to increase the rotational speed of main drive shaft 16. When solenoid operated valve 98 is energized and opened, fluid flows from chamber 64 through line 67 and return line 86 to reservoir 84. Piston 62 then moves to the left as viewed in FIGS. 3 and 5 to rotate output control shaft 32 in a counterclockwise direction and effect movement of link 28 and lever 26 to a position to decrease the opening of main steam control valve 22 for decreasing the steam flow to turbine 10 thereby to decrease the rotational speed of main drive shaft 16. Under certain conditions, it may be desirable to utilize a single valve member with multiple ports instead of two separate valve members.

Electronic control means control the energizing and deenergizing of solenoid operated valves 96 and 98 for controlling the rotation of output control shaft 32 by transmitting predetermined output signals to valves 96 and 98. An electronic module shown generally at 100 has a bottom 101 secured to the planar end surface of governor housing 36 by bolts 102 shown in FIG. 3 and forms an end for housing 36 as shown in FIG. 3. The open area of housing 36 is filled with hydraulic fluid or oil and forms reservoir 84.

To supply power or electrical energy for the operation of the electronic control means, an electric generator 104 is mounted within governor housing 36 and is driven by generator shaft 48 from governor shaft 40. To provide an electrical input signal to electronic module 100 indicating the exact position of output control shaft 32, a linear inductive position sensor indicated at 106 is provided.

Position sensor 106 has a pair of spaced fixed coils or windings 107 with an inner plug or core 109 movable therebetween to provide a change in inductance which is transmitted to a microprocessor of the electronic module 100.

Position sensor 106 is mounted at one end to a bracket 108 secured to an end of generator 104. The other end of position sensor 106 has a rod 110 connected to its inner end to core 109 of position sensor 106 and connected at its outer end to a bracket 114 on yoke 76. Rotational movement of output shaft 32 moves yoke 76 and rod 110. The movement of rod 110 results in an output signal to electronic module 100 indicating the exact position of output control shaft 32 and main control valve 22.

Figure 6:
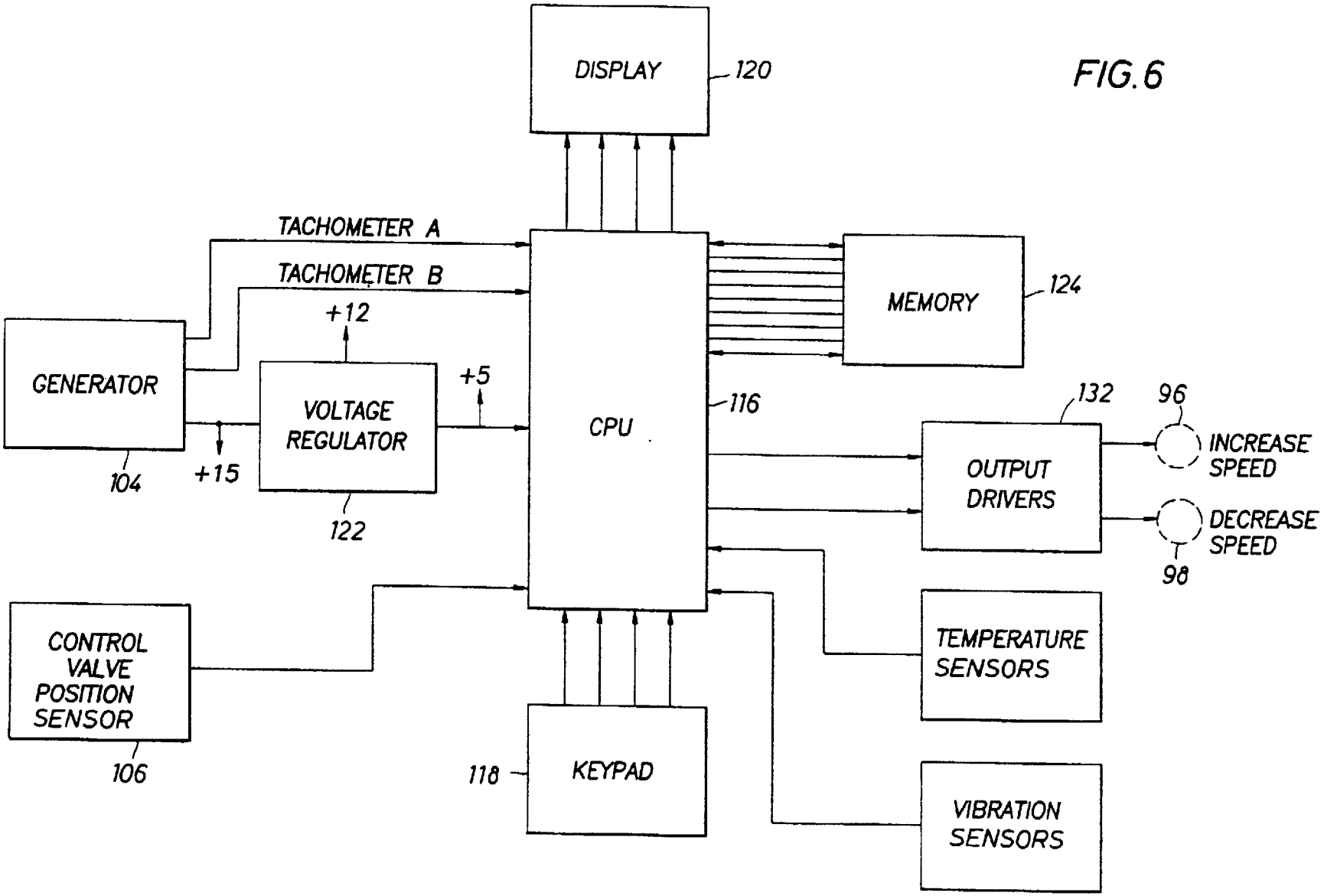
FIG. 6 is a schematic of the electronic control means for the electronic governor of this invention.

Referring now to FIG. 6, a schematic of the electronic control means is illustrated having a CPU or microprocessor indicated at 116. A keypad 118 and display monitor 120 are connected to microprocessor 116. Generator 104 has a pair of windings provided as a redundancy indicated as tachometer A and tachometer B for measuring the rotational speed of main drive shaft 16. Generator shaft 48 is coupled to drive shaft 16 and is driven thereby. Thus, the rotational speed of generator shaft 48 and drive shaft 16 are identical. Generator 104 generates about 15 volts and a voltage regulator 122 provides five (5) volts for the circuitry of microprocessor 116 and twelve (12) volts for actuation of solenoid operated valves 96 and 98. Temperature sensors for governor 34 are mounted at two separate desired locations. Vibration sensors for governor 34 are mounted at two different locations for sensing vibrations of governor 34. Signals from the temperature sensors and vibration sensors are transmitted to microprocessor 116 for display or storage as desired. Input signals from position sensor 106 are likewise transmitted to microprocessor 116. A memory 124 is provided for the storage of desired information or data. A suitable control panel is preferably provided for electronic control module 100 and may, if desired, be controlled from a remote location. The rotational speed of turbine 10 is determined by counting the number of electrical impulses generated by generator 104. Electronic control module 100 includes an analogue circuit board 128 along with a digital circuit board 130. A suitable readout is also provided. If microprocessor 116 determines after processing of input signals that the rotational speed of main drive shaft 16 should be increased, an output signal from an output driver 132 is sent to solenoid operated valve 96 to energize valve 96 for increasing the speed of main drive shaft 16 a predetermined controlled amount. Likewise, if microprocessor 116 determines after processing input signals that the rotational speed of main drive shaft 16 should be decreased, an output signal from an output driver 132 is sent to solenoid operated valve 98 to energize valve 98 for decreasing the speed of main drive shaft 16 a predetermined controlled amount at which solenoid operated valve 98 is deenergized.

From the above, it is apparent that all the power requirements for operation of the main control valve and the electronic governor of the present invention are provided by hydraulic fluid pump 52 and electric generator 104 driven from main shaft 16 without utilizing any external power source such as compressed air or electrical energy. The governor housing 36 forms a reservoir or sump for the hydraulic fluid or oil which is recirculated and no external fluid reservoir is required. Pump 52 is attached to housing 36 and likewise forms an integral part of housing 36. Electronic governor 34 is preferably formed as a compact one piece unit which can be easily coupled to the end of a main drive shaft of a prime mover. While solenoid operated valves have been illustrated in the drawings in a system utilizing hydraulic fluid, it is to be understood that a system utilizing air may be utilized if desired.

While only a single control valve is shown in the drawings for controlling the fluid flow to the prime mover, it is apparent that multiple control valves may be used if desired. Further, particularly with large control valves, a hydraulic pilot valve may be utilized to control an operating cylinder for movement of several control valves. However, the electronic governor comprising the present invention may be utilized for actuation of the pilot valve, which, in turn, controls the movement of the control valve or valves for controlling the rotational speed of the prime mover.

Also, while electronic module 100 is shown in the drawings as connected directly to governor housing 36, electronic module 100 could, if desired, be remote from governor housing 36 or be connected to a different portion of housing 36, as desired. Electronic module 100, if remote from governor 34 or housing 36, would be connected to governor 34 by suitable wired circuitry. In some instances, it may also be desirable to house or mount the fluid control piston 62 at a location remote from governor 34 or governor housing 36.

While a preferred embodiment of the present invention has been illustrated in detail, it is apparent that modifications and adaptations of the preferred embodiment will occur to those skilled in the art. However, it is to be expressly understood that such modifications and adaptations are in the spirit and scope of the present invention as set forth in the following claims.

What is claimed is:

1. A speed control system for a prime mover having a main drive shaft extending therefrom mounted for rotation at a controlled rotational speed; said system comprising:

a main control valve mounted for longitudinal movement to selectively vary the amount of fluid to said prime mover to control the rotational speed of said main drive shaft; and a governor operatively connected to said main control valve to control the movement of said main control valve in response to the rotational speed of said main drive shaft; said governor having hydraulic fluid means operatively connected to said main control valve to effect movement of said main control valve and including a hydraulic fluid pump driven from said main drive shaft for the operation of said fluid means, and electronic control means responsive to the rotational speed of said main drive shaft and transmitting output signals to said hydraulic fluid means to effect movement of said main control valve to a predetermined position;

said governor including an electric generator having a generator shaft driven from said main drive shaft to supply electrical energy to said electronic control means.

2. A speed control system as set forth in claim 1 wherein:

said hydraulic fluid means includes a hydraulic fluid operated piston operatively connected to said main control valve to effect movement of said main control valve; and said hydraulic fluid pump selectively supplies hydraulic fluid to said piston in response to said output signals from said electronic control means for movement of said piston and associated main control valve to a desired position.

3. A speed control system as set forth in claim 2 wherein:

a pair of fluid lines extend to opposed ends of said piston for effecting movement of said piston; and an electronically controlled valve is mounted in each fluid line responsive to output signals from said electronic control means for selective movement of said electronically controlled valve to a desired position.

4. A speed control system as set forth in claim 1 wherein:

said electronic control means includes an electronic module secured to said housing.

5. An electronic governor for controlling the rotational speed of a rotatable main drive shaft of a prime mover comprising:

an outer housing;

an input shaft extending within said housing and arranged to be driven from said rotatable main drive shaft;

an electric generator within said housing having a rotatable shaft driven from said input shaft; and an electronic control means supplied with electrical energy from said electric generator.

6. The governor as set forth in claim 5 wherein:

an output shaft extends from said housing and is arranged for positioning at a predetermined rotatable position to control the position of a main control valve for controlling the supply of fluid to said prime mover for rotating said main drive shaft; and hydraulic fluid control means within said housing is operatively connected to said output shaft and responsive to said electronic control means for movement of said output shaft to a predetermined position for effecting movement of said main control valve.

7. The governor as set forth in claim 6 wherein:

said hydraulic fluid control means includes a hydraulic pump arranged to be driven from said main drive shaft, and a fluid operating piston operatively connected to said output shaft for effecting rotation of said output shaft to a predetermined position, said fluid control means providing fluid to said piston for controlling the movement of said piston and associated output shaft.

8. The governor as set forth in claim 7 wherein:

fluid lines extend from said hydraulic pump to supply fluid to opposed ends of said piston; and electronically operated valve means are positioned in said fluid lines responsive to said electronic control means to control the flow of fluid to said piston for movement of said piston and said output shaft to a predetermined position.

9. An electronic governor for controlling the rotational speed of a rotatable main drive shaft of a prime mover having a main control valve to control the flow of fluid to said prime mover for rotation of said main drive shaft; said governor comprising:

hydraulic control means for said main control valve including a hydraulic fluid pump driven from said main drive shaft, a fluid operated piston operatively connected to said control valve to effect selective movement of said control valve, and fluid lines for said piston to supply fluid to opposed ends of said piston from said pump;

electronically operated valve means for said fluid lines to permit the supply of fluid to said piston selectively from said pump;

electronic control means operatively connected to said electronically operated valve means for selective actuation of said electronically operated valve means to control the flow of fluid to said piston, said electronic control means being responsive to the rotational speed of said main drive shaft and effective to vary the rotational speed of said main drive shaft by selective actuation of said electronically operated valve means; and said governor having an electric generator to supply electrical energy to said electronic control means for operation thereof, said electric generator having a generator shaft driven from the main drive shaft of said prime mover.

10. The electronic governor as set forth in claim 9 wherein said governor has an outer housing and said electric generator is mounted within said housing.

11. The electronic governor as set forth in claim 10 wherein said electronic control means is mounted on said housing and senses the position of the main control valve, said electronic control means providing output signals to said electronically operated valve means for selective operation of said electronically operated valve means.

12. The electronic governor as set forth in claim 9 wherein said hydraulic fluid pump has a pump shaft in axial alignment with and connected to said generator shaft, and said pump shaft and said generator shaft are driven from said main drive shaft.

13. In a turbine having a rotatable main drive shaft and an electronic governor for controlling the rotational speed of said turbine, the electronic governor having a housing with an input shaft driven from said rotatable main drive shaft and a fluid responsive piston operatively connected to a steam valve to control the flow of steam to the turbine; an improved electronic control means for said governor comprising:

an electrical power source within said housing of said governor operatively connected to said input shaft for driving of said electrical power source to provide the sole energy supply for operation of said electronic control means;

said electronic control means including means responsive to the rotational speed of said turbine for actuation of said fluid responsive piston to control the flow of steam to said turbine.

14. In a turbine as set forth in claim 13 wherein:

said means responsive to the rotational speed of said turbine includes electronically operated valve means to control the flow of fluid to said fluid operated piston, said electronically operated valve means being responsive to said electronic control means and actuated in response to the rotational speed of said main drive shaft.

15. In a turbine as set forth in claim 13 wherein said electrical power source comprises an electric generator within said housing and having a generator shaft coupled to said input shaft for rotation.

16. In a turbine as set forth in claim 15 wherein said electronic control means includes an electronic module secured to said housing of said governor.

* * * * *